US008726448B2

(12) United States Patent
Kato et al.

(10) Patent No.: US 8,726,448 B2
(45) Date of Patent: May 20, 2014

(54) CORE/SHEATH COMPOSITE FILAMENT FOR TOOTHBRUSHES, AND TOOTHBRUSH USING SAME

(75) Inventors: Keisuke Kato, Takatsuki (JP); Nobuhisa Hyodo, Okazaki (JP); Chikara Tanaka, Okazaki (JP)

(73) Assignee: Sunstar Inc., Takatsuki-shi (JP)

( * ) Notice: Subject to any disclaimer, the term of this patent is extended or adjusted under 35 U.S.C. 154(b) by 0 days.

(21) Appl. No.: 13/509,105

(22) PCT Filed: Nov. 10, 2010

(86) PCT No.: PCT/JP2010/069975

§ 371 (c)(1),
(2), (4) Date: Jun. 21, 2012

(87) PCT Pub. No.: WO2011/058985

PCT Pub. Date: May 19, 2011

(65) Prior Publication Data

US 2012/0246857 A1 Oct. 4, 2012

(30) Foreign Application Priority Data

Nov. 13, 2009 (JP) ..... 2009-260328
Nov. 13, 2009 (JP) ..... 2009-260396
Nov. 5, 2010 (JP) ..... 2010-248013

(51) Int. Cl.
*A46B 9/04* (2006.01)

(52) U.S. Cl.
USPC ..... 15/207.2; 15/167.1

(58) Field of Classification Search
None
See application file for complete search history.

(56) References Cited

U.S. PATENT DOCUMENTS

2002/0189041 A1* 12/2002 Duff et al. ..... 15/167.1
2003/0019064 A1* 1/2003 Martinez Antonio ..... 15/167.1
2009/0013484 A1* 1/2009 Roberts et al. ..... 15/110

FOREIGN PATENT DOCUMENTS

| | | | |
|---|---|---|---|
| JP | 60-88110 | | 5/1985 |
| JP | 5-123222 | | 5/1993 |
| JP | 10-313946 | | 12/1998 |
| JP | 2004-225214 | A1 | 8/2004 |
| JP | 2006-130012 | A1 | 5/2006 |
| JP | 2008-183093 | A1 | 8/2008 |
| JP | 2009-89920 | A1 | 4/2009 |
| JP | 2009-201794 | | 9/2009 |
| WO | WO 2007/123013 | A1 | 11/2007 |

OTHER PUBLICATIONS

International Search Report for International Applicaton No. PCT/JP2010/069975 dated December 14, 2010.

* cited by examiner

*Primary Examiner* — Monica Carter
*Assistant Examiner* — Stephanie Berry
(74) *Attorney, Agent, or Firm* — Kratz, Quintos & Hanson, LLP

(57) ABSTRACT

Provided is a core/sheath composite filament for toothbrushes which exhibits excellent hardness, durability and feeling of use when used in toothbrushes, is less prone to falling out when tufted into the tufting plate, and makes it possible to improve stain-removal properties. Also provided is a toothbrush using said core/sheath composite filament. A toothbrush is configured using bundles of bristles configured from core/sheath composite filaments that have a quadrangular cross section in the plane perpendicular to the lengthwise direction and comprise a core (2), which is formed from a synthetic resin fiber, and a sheath (3), which integrally covers the core (2) and is formed from an elastomer that is compatible with the synthetic resin constituting the core (2). Tufts configured from a plurality of the core/sheath composite filaments (1) are tufted in the center portion of a tufting plate.

9 Claims, 6 Drawing Sheets

(a)

(b)

(a)

(b)

(a)

(b)

CORE/SHEATH COMPOSITE FILAMENT FOR TOOTHBRUSHES, AND TOOTHBRUSH USING SAME

TECHNICAL FIELD

The present invention relates to a core/sheath composite filament for toothbrushes which can be preferably used for removing stains (color) from the surface of teeth, and a toothbrush using the core/sheath composite filament.

BACKGROUND ART

As a filament for toothbrushes, there have been proposed a filament which is made of a single synthetic resin material and whose cross section perpendicular to the lengthwise direction is formed into a rectangular shape so that the contact area of surface contact between the filament and the surface of teeth is set to be large, thereby improving the stain removal property (See Patent Document 1, for example), and a core/sheath composite filament which is composed of a bristle which is formed from an ultrafine fiber made of polyamide and a rubber layer which covers the bristle, and has less irritation to gums (See Patent Document 2, for example).

Further, as a core/sheath composite filament whose cross section has a shape other than a circular shape, there have been proposed a core/sheath composite filament having a core and a sheath which are respectively made of polyethylene terephthalate and polybutylene terephthalate (hereinafter, abbreviated as PBT), polyester elastomer and PBT, polypropylene terephthalate and PBT, polyethylene naphthalate and PBT, polyester elastomer and polyethylene terephthalate, or the like, wherein a cross section of the core, the cross section being perpendicular to the lengthwise direction of the fiber, is formed into a star shape, an eight-leaf shape, or the like, and a cross section of the sheath, the cross section being perpendicular to the lengthwise direction of the fiber, is formed into a triangular shape, a square shape, or an eight-leaf shape (See Patent Document 3, for example), and a core/sheath composite filament which includes a conductive polymer which is made of polyester containing conductive particles as a sheath component and a non-conductive polymer which is made of polyethylene terephthalate as a core component, wherein a cross section of the core, the cross section being perpendicular to the lengthwise direction of the fiber, is formed into a circular shape or a triangular shape, and a cross section of the sheath, the cross section being perpendicular to the lengthwise direction of the fiber, is formed into a triangular shape or a quadrangular shape (See Patent Document 4, for example).

CITATION LIST

Patent Literatures

Patent Document 1: JP-A No. H10-313946
Patent Document 2: JP-A No. H5-123222
Patent Document 3: JP-A No. 2009-89920
Patent Document 4: JP-A No. 2004-225214

SUMMARY OF INVENTION

Technical Problem

In the meantime, although the mechanism of removing stains from the surface of teeth has not yet been clarified so far, it is known that it is possible to efficiently remove stains by forming the cross section of the filament, the cross section being perpendicular to the lengthwise direction, into a rectangular shape as described in Patent Document 1. However, when a filament which is made of a single synthetic resin material is used as described in Patent Document 1, although the stain removal property can be improved, there have been problems in that an appropriate hardness for a toothbrush cannot be obtained, the brush tip surface of the toothbrush are prone to spread out and the durability is thus reduced, and the feeling of use at the time of brushing is deteriorated.

It is an object of the present invention to provide a core/sheath composite filament for toothbrushes which exhibits excellent hardness, durability and feeling of use when used in toothbrushes, is less prone to losing when tufted into a tufting plate, and makes it possible to improve stain removal property, and a toothbrush using the core/sheath composite filament.

Solution to Problem

The core/sheath composite filament for toothbrushes according to the present invention includes a core made of a synthetic resin fiber and a sheath integrally covering the core, the sheath being made of an elastomer compatible with the synthetic resin constituting the core, wherein a cross section of the core/sheath composite filament, the cross section being perpendicular to the lengthwise direction, is formed into a quadrangular shape.

In the core/sheath composite filament for toothbrushes, since the cross section which is perpendicular to the lengthwise direction has a quadrangular shape, it is possible to sufficiently ensure the stain removal property when used in a toothbrush. Although the mechanism of removing stains has not yet been clarified so far, it is presumed that stains can be efficiently removed by using a fiber having a quadrangular cross section as in the present invention, since it becomes possible to set the contact area of surface contact between the surface of teeth and the core/sheath composite filament to be large and also to strongly brush the surface of the teeth with corners of the core/sheath composite filament having a quadrangular cross section. In addition, it is presumed that stains can also be efficiently removed by brushing an elastomer having rubber elasticity on the surface of teeth. Further, since the sheath is made of an elastomer in the present invention, when fine abrasive particles contained in a dentifrice are put between the core/sheath composite filament and the surface of teeth, the fine abrasive particles are rubbed on the surface of teeth while digging into and being held by the elastomer, thereby making it possible to efficiently remove dental plaque and stains. In addition to this, the frictional resistance among the core/sheath composite filaments and the frictional resistance between the core/sheath composite filaments and the tufting plate are made to be large by the elastomer, it is possible to improve the pullout strength of the core/sheath composite filaments tufted in the tufting plate.

Further, since the core is composed of a synthetic resin fiber, it is possible to obtain the core/sheath composite filament having a moderate hardness which is usable in a toothbrush by appropriately adjusting the constituent material, the diameter and the like of the core. Furthermore, even though the core/sheath composite filament has an angular shape, which means that irritation caused by a contact between the core/sheath composite filament and gums or the inside of a mouth becomes strong, it is possible to suppress the irritation and thereby to improve the feeling of use since the sheath portion of the core/sheath composite filament is covered by an elastomer. In addition, since the core made of a synthetic resin is covered by the sheath composed of an elastomer, it is possible to reduce the influence of water on the synthetic resin fiber, thereby making it possible to remedy a problem in that the brush tip surface of the toothbrush spread out and the durability is therefore decreased.

In this regard, it is a preferred embodiment that the core is made of a polyester-based synthetic resin fiber and the sheath is made of a thermoplastic elastomer (TPE). Especially, it is a preferred embodiment that the core is made of polybutylene terephthalate (PBT) and the sheath is made of a polyester-based thermoplastic elastomer (TPE). The use of polybutylene terephthalate as the synthetic resin material constituting the core makes it possible to sufficiently ensure the stiffness of the core/sheath composite filament. Further, a thermoplastic elastomer is preferable since the core/sheath fiber can be easily manufactured by coextrusion molding of a thermoplastic elastomer and the synthetic resin material constituting the core.

It is a preferred embodiment that the length on each side of the cross section of the core/sheath composite filament is in the range of 0.14 to 0.30 mm. When the length on each side of the cross section of the core/sheath composite filament is less than 0.14 mm, there are problems in that a moderate hardness for a toothbrush cannot be obtained, the durability is inferior, and a sufficient stain removal effect cannot be obtained. On the other hand, when the length on each side of the cross section of the core/sheath composite filament is more than 0.30 mm, there are problems in that it is too hard for a toothbrush and the feeling of use becomes deteriorated. Therefore, the length on each side of the cross section of the core/sheath composite filament is preferably set in the range of 0.14 to 0.30 mm.

It is a preferred embodiment that a cross section of the core, the cross section being perpendicular to the lengthwise direction, has a circular shape. Although the cross sectional shape of the core can be arbitrarily determined, it is preferable to form the cross section of the core into a circular shape so that the hardness, namely stiffness, of the core/sheath composite filament can be set to be uniform over the entire circumference because the core is provided mainly for ensuring the hardness of the core/sheath composite filament as described above.

It is a preferred embodiment that the diameter of the core is set in the range of 0.12 to 0.27 mm. The diameter of the core is preferably set to 0.12 mm or more, since the durability is decreased when the diameter is less than 0.12 mm. Further, the upper limit value of the diameter of the core is preferably set to 0.27 mm or less in order to prevent the core/sheath composite filament from becoming too hard, thereby preventing the feeling of use from being deteriorated.

It is also a preferred embodiment that an outer surface of the sheath is formed into a concave shape so as to be gently depressed inwardly. In this case, it is possible to hold a dentifrice in a concave portion of the outer surface of the sheath. Therefore, it is possible to efficiently clean the surface of teeth while sufficiently rubbing the dentifrice on the surface of teeth.

The toothbrush according to the present invention includes a brush portion having a tufting plate and a plurality of tufts tufted in the tufting plate, wherein the tuft including the core/sheath composite filament for toothbrushes is used in the toothbrush. Since the core/sheath composite filament is used in the toothbrush, it is possible to obtain the same effect as described above.

It is a preferred embodiment that centers of tufting holes, the tufting holes being adjacent to each other in the longitudinal direction of the toothbrush, have a portion not being located on a straight line parallel to the longitudinal direction of the toothbrush in the tufting plate. The tufts can be arranged in the tufting plate in an aligned arrangement (matrix state). However, it is a preferred embodiment that the tufts are tufted in the tufting plate in a zigzag arrangement so that the surface of teeth can be uniformly brushed, since the filament density in a tip portion (a portion which slides on teeth) of the brush portion is low between the adjoining tufts, and a portion having low filament density slides on the same part of the surface of teeth when brushing teeth by the Bass brushing method or the rolling-stroke brushing method, thereby creating a portion which remains unbrushed in the part on which the portion having low filament density slides and deteriorating the stain removal ability. In this regard, the arrangement of the tufts (tufting holes) on the tufting plate, with respect to the longitudinal direction of the toothbrush (hereinafter, referred to as a row direction) and the direction perpendicular thereto (hereinafter, referred to as a column direction), may be a zigzag state in which at least one pair of centers of the tufting holes, the tufting holes being located nearest to each other in adjoining columns, is not located on a straight line which is parallel to the longitudinal direction of the toothbrush, an aligned state in which each of centers of the tufting holes, the tufting holes being located nearest to each other in adjoining columns, is all located on a straight line which is parallel to the longitudinal direction of the toothbrush, or a composite state which combines the zigzag state with the aligned state. In this specification, even in the composite state combining the aligned state with the zigzag state, a state in which three or more columns of the tufting holes in an aligned state are continuously provided is collectively referred to as "an aligned arrangement" together with the full aligned state, and a state in which two or less columns of the tufting holes in an aligned state are continuously provided is collectively referred to as "a zigzag arrangement" together with the full zigzag state.

It is a preferred embodiment that the tufts include a tuft configured by bundling a plurality of the core/sheath composite filaments and tufted in a central part of the tufting plate and a tuft configured by bundling a plurality of monofilaments made of a hard synthetic resin and tufted in a peripheral part of the tufting plate. Such a configuration makes it possible to adjust the brush stiffness without exerting any effect on the feeling of use by virtue of the monofilament which is made of a hard synthetic resin while at the same time improving the stain removal power by virtue of the core/sheath composite filament. As a result of this, it becomes possible to design toothbrushes of various hardness corresponding to preferences of users.

Advantageous Effects of Invention

According to the core/sheath composite filament for toothbrushes and the toothbrush using the same, it is possible to sufficiently ensure the stain removal property since the core/sheath composite filament whose cross section perpendicular to the lengthwise direction has a quadrangular shape is used as the filament constituting the brush portion. Further, since the sheath of the core/sheath composite filament is composed of an elastomer, when fine abrasive particles contained in a dentifrice are put between the core/sheath composite filament and the surface of teeth, the fine abrasive particles are rubbed on the surface of teeth while digging into and being held by the elastomer, thereby making it possible to efficiently remove dental plaque and stains. Furthermore, since the core is composed of a synthetic resin fiber, it is possible to obtain the core/sheath composite filament having a moderate hardness which is usable in a toothbrush by appropriately adjusting the constituent material, the diameter and the like of the core. Furthermore, even though the core/sheath composite filament has an angular shape, which means that irritation caused by a contact between the core/sheath composite filament and gums or the inside of a mouth becomes strong, it is possible to suppress the irritation and thereby to improve the feeling of use since the sheath portion of the core/sheath composite filament is covered by an elastomer. In addition, since the core made of a synthetic resin is covered by the sheath composed of an elastomer, it is possible to reduce the influence of water on the synthetic resin fiber, thereby making it possible to remedy a problem in that the bristle tips of the brush spread out and the durability is therefore decreased. In addition to this, the frictional resistance among the core/sheath composite filaments and the frictional resistance between the core/sheath composite filaments and the tufting plate are made to be large by the elastomer, it is possible to improve the pullout strength of the core/sheath composite filaments tufted in the tufting plate.

DESCRIPTION OF EMBODIMENTS

Figure 1:
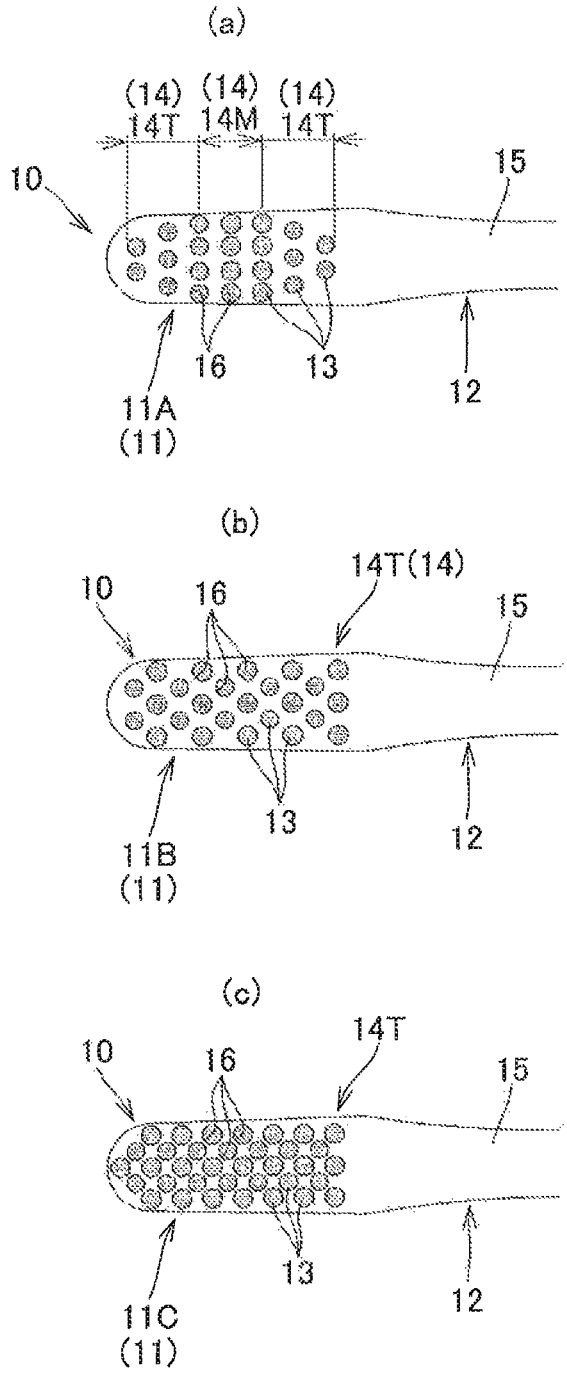
FIG. 1 (*a*), FIG. 1 (*b*) and FIG. 1 (*c*) are front views each showing a tufting plate and a neighboring area of the tufting plate of a toothbrush, wherein the arrangement of tufts in the toothbrush shown in each of FIGS. 1 (*a*) to 1 (*c*) is different from that in the other two toothbrushes.

Hereinafter, embodiments of the present invention will be described with reference to the drawings.

As shown in FIGS. 1 to 4, a toothbrush 10 includes a handle 12 which is provided with a tufting plate 11 in a tip portion thereof and a brush portion 14 which is composed of the tufting plate 11 and a plurality of tufts 13 tufted in the tufting plate 11. As a filament constituting the tuft 13, there is used a core/sheath composite filament 1 which includes a core 2 which is made of a synthetic resin fiber and a sheath 3 which integrally covers the core 2 and is made of an elastomer that is compatible with the synthetic resin constituting the core 2, and has a quadrangular cross section in the plane perpendicular to the lengthwise direction. In this embodiment, although a description will be made with regard to a case where the core/sheath composite filament of the present invention is applied to a toothbrush 10 of manual type, it is also possible to apply the core/sheath composite filament of the present invention to a brush portion of a powered toothbrush in the same manner.

The handle 12 includes a grip portion (not shown) which is to be held by a hand for a brushing operation, a neck portion 15 which extends continuously from the grip portion, and the tufting plate 11 which is provided in a tip portion of the neck portion 15, and is integrally molded by injection molding and the like using a synthetic resin material. In this regard, it is also possible to employ a handle 12 which is formed in such a manner that a primary molded article is molded by injection molding, the primary molded article is then set in another mold, and an anti-slip portion and a finger putting portion which are made of an elastomer, for example, are then post-formed thereon. As a synthetic resin material constituting the handle 12, it is possible to use a hard synthetic resin material such as polypropylene, polyethylene, polyethylene terephthalate, polybutylene terephthalate, polyethylene naphthalate, polytrimethyl terephthalate, polycarbonate, polyoxymethylene, styrene-acrylonitrile resin, acrylonitrile-butadiene-styrene resin, cellulose propionate, polyamide, polymethyl methacrylate, and polyarylate, for example.

The tufting plate 11 is formed into a flat plate-like shape having a rectangular or egg-shaped front face whose corners are rounded off in order to carry out a brushing operation inside a mouth smoothly. A plurality of tufting holes 16 are formed in the front face of the tufting plate 11 in a predetermined arrangement. The arrangement of the tufting holes 16 is arbitrarily determined. For example, the arrangement of the tufting holes 16, with respect to the longitudinal direction of the handle 12 (a row direction) and the direction perpendicular thereto (a column direction), may be a zigzag state in which at least one pair of centers of the tufting holes 16, the tufting holes 16 being located nearest to each other in adjoining columns, is not located on a straight line which is parallel to the longitudinal direction of the toothbrush, an aligned state in which each of centers of the tufting holes 16, the tufting holes 16 being located nearest to each other in adjoining columns, is all located on a straight line which is parallel to the longitudinal direction of the toothbrush, or a composite state which combines the zigzag state with the aligned state. In particular, it is possible to employ an aligned arrangement where a brush portion 14T in which three columns of the tufting holes 16 are continuously arranged in a zigzag state, a brush portion 14M in which three columns of the tufting holes 16 are continuously arranged in an aligned state, and a brush portion 14T in which three columns of the tufting holes 16 are continuously arranged in a zigzag state are provided in the tufting plate 11 from the tip side thereof in this order, as a tufting plate 11A shown in FIG. 1 (*a*) and a tufting plate 11G shown in FIG. 3 (*a*), a zigzag arrangement where only a brush portion 14T in which ten columns of the tufting holes 16 are continuously arranged in a zigzag state is provided in the tufting plate 11, as a tufting plate 11B shown in FIG. 1 (*b*), a zigzag arrangement where fifteen columns of the tufting holes 16 are continuously arranged in a zigzag state so as to increase the arrangement density of the tufting holes 16 compared to the tufting plate 11B, as a tufting plate 11C shown in FIG. 1 (*c*), and an aligned arrangement where only a brush portion 14M in which eight columns of the tufting holes 16 are continuously arranged in an aligned state is provided in the tufting plate 11, as a tufting plate 11H shown in FIG. 3 (*b*). Further, it is also possible to employ a zigzag arrangement where a brush portion 14T in which three columns of the tufting holes 16 are continuously arranged in a zigzag state, a brush portion 14M in which two columns of the tufting holes 16 are continuously arranged in an aligned state, and a brush portion 14T in which five columns of the tufting holes 16 are continuously arranged in a zigzag state are provided in the tufting plate 11 from the tip side thereof in this order, as a tufting plate 11D shown in FIG. 2 (*a*), a zigzag arrangement where a brush portion 14T in which three columns of the tufting holes 16 are continuously arranged in a zigzag state, a brush portion 14M in which two columns of the tufting holes 16 are continuously arranged in an aligned state, and a brush portion 14T in which six columns of the tufting holes 16 are continuously arranged in a zigzag state are provided in the tufting plate 11 from the tip side thereof in this order, as a tufting plate 11E shown in FIG. 2 (*b*), and a zigzag arrangement where only a brush portion 14T in which eight columns of the tufting holes 16 are continuously arranged in a zigzag state is provided in the tufting plate 11, as a tufting plate 11F shown in FIG. 2 (*c*). In this regard, even in the composite arrangement which combines the aligned state with the zigzag state, the tufting plate 11A shown in FIG. 1 (*a*) and the tufting plate 11G shown in FIG. 3 (*a*) are categorized as the aligned arrangement since each of the tufting plate 11A and the tufting plate 11G is provided with three or more continuous columns of the tufting holes 16 in an aligned state. On the other hand, the tufting plate 11D shown in FIG. 2 (*a*) and the tufting plate 11E shown in FIG. 2 (*b*) are categorized as the zigzag arrangement since each of the tufting plate 11D and the tufting plate 11E is provided with two or less continuous columns of the tufting holes 16 in an aligned state.

When the tufting holes 16 are arranged in a zigzag state, it is preferable to provide five or more continuous columns of the tufting holes 16 so as to prevent unbrushing. For example, it is preferable to provide five continuous columns of the tufting holes 16 as in the tufting plate 11D in FIG. 2 (*a*), six continuous columns of the tufting holes 16 as in the tufting plate 11E in FIG. 2 (*b*), eight continuous columns of the tufting holes 16 as in the tufting plate 11F in FIG. 2 (*c*), ten continuous columns of the tufting holes 16 as in the tufting plate 11B in FIG. 1 (*b*), or fifteen continuous columns of the tufting holes 16 as in the tufting plate 11C in FIG. 1 (*c*).

As a method for tufting the tufts 13 into the tufting plate 11, it is possible to employ a method in which the tufting holes 16 each having a bottom are formed on the tufting plate 11 at the time of molding the handle 12, and the tufts 13 are then tufted into the tufting holes 16 using an anchor wire. In this regard, it is also possible to employ a method in which the tufting plate 11 is configured to be divided into a front part and a back part, tufts are inserted into through holes which are formed in the front part of the tufting plate, base end portions of the tufts are then melted by heating means so that filaments of each of the tufts are fused with each other, and the back part of the tufting plate is then put on and bonded to the front part of the tufting plate to thereby form the tufting plate 11.

As the tuft 13, a tuft 13 which is composed of only the core/sheath composite filaments 1 can be used, or a tuft which is composed of the core/sheath composite filaments 1 and monofilaments 5 made of a hard synthetic resin in a mixed state can also be used. When the core/sheath composite filaments 1 and the monofilaments 5 are used in a mixed state, the mixture ratio can be arbitrarily set in view of the strength, the durability and the feeling of use of the toothbrush 10. The mixture ratio can also be changed depending on sites of the tufting plate 11 in which each of the tufts 13 is tufted. Further, it is also possible that filaments having different characteristics be arranged depending on sites of the tufting plate 11 in which each of the tufts 13 is used. For example, the core/sheath composite filaments 1 are arranged in a central part of each of the tufts 13 and the monofilaments 5 are arranged in an outer circumferential part of each of the tufts 13. Further, the number of the filaments which are tufted into each of the tufting holes 16 can be arbitrarily set. Namely, it is possible to tuft the same number of the filaments with respect to all of the tufting holes 16 provided on the tufting plate 11, and also possible to tuft the different number of the filaments with respect to each of the tufting holes 16 depending on the provided positions of the tufting hole 16.

Figure 2:
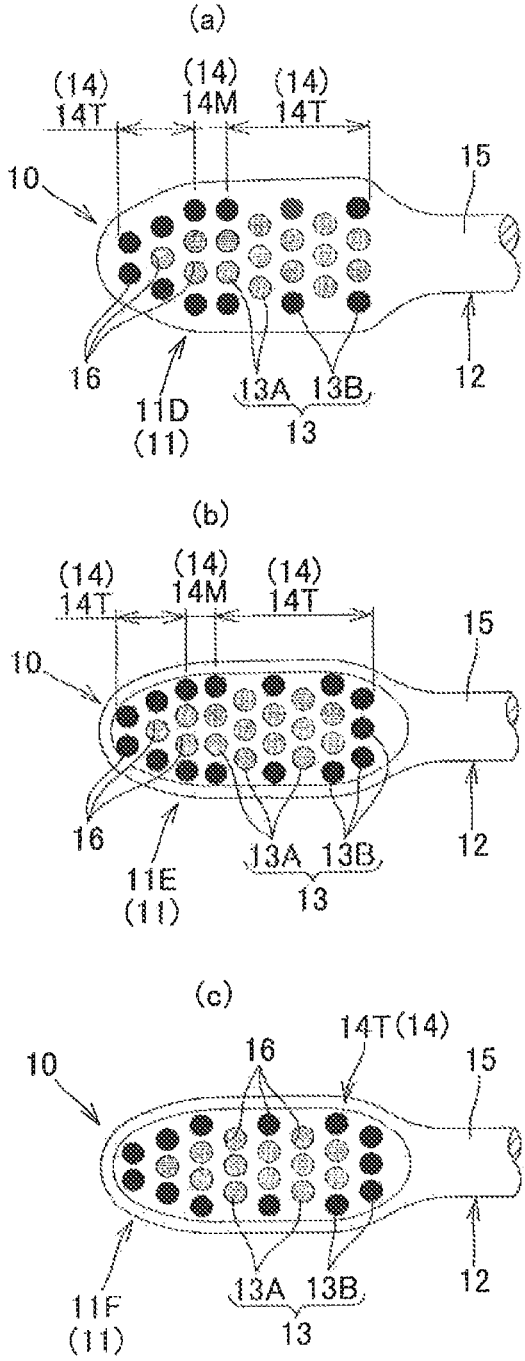
FIG. 2 (*a*), FIG. 2 (*b*) and FIG. 2 (*c*) are front views each showing a tufting plate and a neighboring area of the tufting plate of a toothbrush, wherein the arrangement of tufts in the toothbrush shown in each of FIGS. 2 (*a*) to 2 (*c*) is different from that in the other two toothbrushes.
Figure 3:
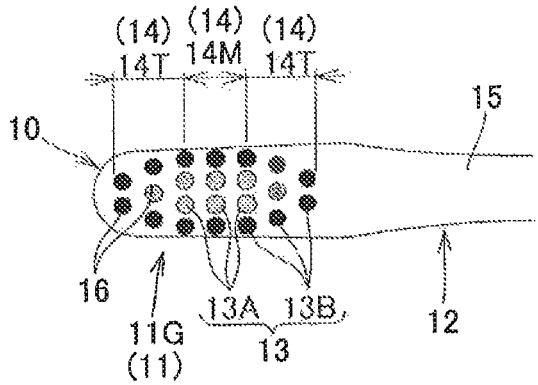
FIG. 3 (*a*) and FIG. 3 (*b*) are front views each showing a tufting plate and a neighboring area of the tufting plate of a toothbrush, wherein the arrangement of tufts in the toothbrush shown in FIG. 3 (*a*) is different from that in the toothbrush shown in FIG. 3 (*b*).
Figure 3:
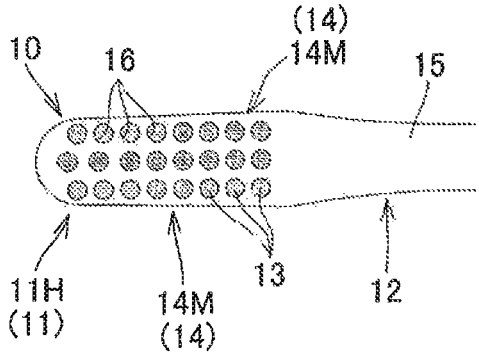

Further, as shown in FIGS. 2 (*a*) to 2(*c*) and FIG. 3 (*a*), it is also possible to tuft the tufts 13A each of which is composed of only the core/sheath composite filaments 1 and the tufts 13B each of which is composed of only the monofilaments 5 in one tufting plate 11 in a mixed state. When the tufts 13A and the tufts 13B are tufted in a mixed state, it is possible to arrange tufts each of which is composed of filaments having different characteristics depending on sites of the tufting plate 11 in which each of the tufts is tufted. For example, the tufts 13B each of which is composed of the monofilaments 5 are arranged in a peripheral part of the tufting plate 11, and the tufts 13A each of which is composed of the core/sheath composite filaments 1 are arranged inside the peripheral part, that is, in a central part of the tufting plate 11. For example, as shown in FIGS. 2 (*a*) to 2 (*c*) and FIG. 3 (*a*), it is possible to design the toothbrushes 10 of various hardness corresponding to preferences of users by virtue of the monofilament 5 which is made of a hard synthetic resin while improving the stain removal power by virtue of the core/sheath composite filament 1 by configuring the tufts 13 in such a manner that tufts 13 that are indicated by black (not gray) circles are composed of the tuft 13B which is composed of the monofilaments 5 and the other tufts 13 are composed of the tuft 13A which is composed of the core/sheath composite filaments 1, namely, the tufts 13A each of which is composed of the core/sheath composite filaments 1 are arranged in the central part of the tufting plate 11 and the tufts 13B each of which is composed of the hard monofilaments 5 are arranged in the peripheral part of the tufting plate 11. Further, it is preferable to tuft the tufts 13A each of which is composed of the core/sheath composite filaments 1 in the end portion of the tufting plate 11 at the side of the handle 12 as shown in FIG. 2(*a*), instead of the tufts 13B each of which is composed of the monofilaments 5 as shown in FIGS. 2 (*b*), 2 (*c*) and 3 (*a*). Namely, since there has been widely adopted a brushing method in which the back of front teeth is brushed with the end portion of the brush portion 14 at the side of the handle 12 with the toothbrush being held vertically, it is possible to efficiently remove stains on the back of front teeth by tufting the tufts 13A each of which is composed of the core/sheath composite filaments 1 in the end portion of the tufting plate 11 at the side of the handle 12.

It is possible to employ the monofilament 5 which is made of a well-known material as long as it has a physical property usable in the toothbrush 10. For example, it is possible to use a resin material such as nylon, polyester and polyolefin. The cross sectional shape of the monofilament 5 may be a circular shape, an oval shape, or a polygonal shape such as a triangular shape and a quadrangular shape. Further, it is also possible to use various types of the monofilaments 5 having different cross sectional sizes or different cross sectional shapes in a mixed state. The tip portion of the monofilament 5 can be formed into an arbitrarily shape such as a spherical shape, a hemispherical shape, and a sharp-pointed shape.

When the outer diameter of the monofilament 5 is less than 0.16 mm, sufficient stiffness of the bristle cannot be obtained. On the other hand, when the outer diameter of the monofilament 5 is more than 0.26 mm, the insertability into interproximal portions and the feeling of use are deteriorated. Accordingly, the outer diameter of the monofilament 5 is preferably set in the range of 0.16 to 0.26 mm, and particularly preferably in the range of 0.20 to 0.22 mm.

Figure 4:
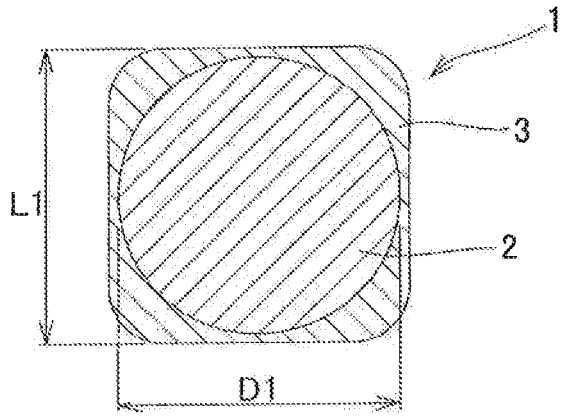
FIG. 4 (*a*) is a cross sectional view showing a core/sheath composite filament according to one embodiment of the present invention, and FIG. 4 (*b*) is a cross sectional view showing a core/sheath composite filament according to another embodiment of the present invention.
Figure 4:
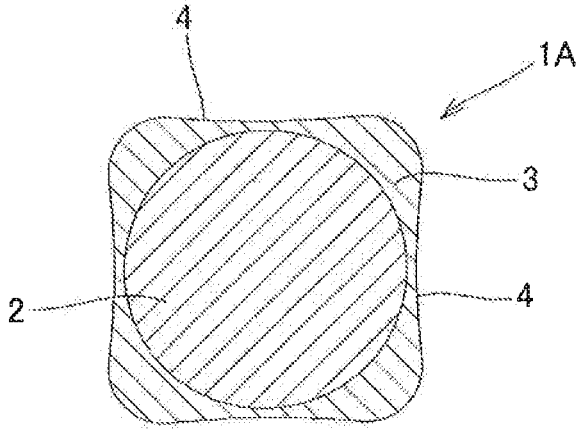

As shown in FIG. 4, the core/sheath composite filament 1 includes a core 2 which is made of a synthetic resin fiber and a sheath 3 which integrally covers the core 2 and is made of an elastomer that is compatible with the synthetic resin constituting the core 2.

As the synthetic resin material constituting the core 2, it is possible to use a synthetic resin material such as a polyamide-based synthetic resin material, a polyester-based synthetic resin material, and a polyolefin-based synthetic resin material. In particular, Nylon 610, Nylon 612 and the like can be used as a polyamide-based synthetic resin material, polybutylene terephthalate (PBT), polytrimethylene terephthalate (PTT), polyethylene terephthalate (PET) and the like can be used as a polyester-based synthetic resin material, and polypropylene, polyethylene and the like can be used as a polyolefin-based synthetic resin material.

As the elastomer constituting the sheath 3, it is possible to use a thermoplastic elastomer (TPE) such as a polystyrene-based thermoplastic elastomer (SBC), a polyolefin-based thermoplastic elastomer (TPO), a polyvinyl chloride-based thermoplastic elastomer (TPVC), a polyurethane-based thermoplastic elastomer (PU), a polyester-based thermoplastic elastomer (TPEE), and a polyamide-based thermoplastic elastomer (TPAE), for example. Among these elastomers, a polyester-based thermoplastic elastomer and a polyamide-based thermoplastic elastomer (TPAE) are preferably used, and a polyester-based thermoplastic elastomer is particularly preferably used due to the excellent handleability thereof.

A thermoplastic elastomer is basically composed of a hard segment (a resin component) and a soft segment (a rubber component). However, a polyvinyl chloride-based thermoplastic elastomer is an exception. In particular, in a polystyrene-based thermoplastic elastomer, polystyrene is used as the hard segment, and butadiene is used as the soft segment. Further, in a polyolefin-based thermoplastic elastomer, a polyolefin-based synthetic resin material such as polypropylene and polyethylene is used as the hard segment, and an olefin-based rubber such as an ethylene-propylene rubber (EPR) and an ethylene-propylene-diene rubber (EPDM) is used as the soft segment. In a polyurethane-based thermoplastic elastomer, polyurethane is used as the hard segment, and polyol, polyester or the like is used as the soft segment. In a polyester-based thermoplastic elastomer, polyester is used as the hard segment, and aliphatic polyether, polyester or the like is used as the soft segment. In a polyamide-based thermoplastic elastomer, nylon oligomer is used as the hard segment, and polyol, polyester or the like is used as the soft segment. As a polyvinyl chloride-based thermoplastic elastomer, it is possible to use plasticized highly polymerized polyvinyl chloride, acrylonitrile-butadiene rubber (NBR) modified polyvinyl chloride, and the like.

The Type D durometer hardness specified in JIS K 6253 of the elastomer constituting the sheath 3 is preferably in the range of 27D to 94D, more preferably in the range of 55D to 72D, even more preferably in the range of 60D to 72D, and the most preferably in the range of 65D to 72D since the tuftedability may be significantly deteriorated when the Type D durometer hardness is less than 27D, and on the other hand, the elasticity is reduced when the Type D durometer hardness is more than 94D.

The core/sheath composite filament 1 is manufactured by a well-known composite melt spinning method. In particular, the synthetic resin material constituting the core 2 and the elastomer material constituting the sheath 3 are respectively melted and discharged from a composite extruder so as to be formed into a desired shape, cooled, stretched, and then subjected to heat-setting to thereby manufacture the core/sheath composite filament 1. Further, it is possible that the core/sheath composite filaments 1 are bundled and cut into a predetermined length, and then the tip portion of each of the filaments 1 is formed into an arbitrary shape such as a spherical shape, a hemispherical shape, and a sharp-pointed shape.

Although a cross section of the core 2, the cross section being perpendicular to the lengthwise direction, can be formed into an arbitrary shape such as a polygonal shape, an oval shape, a circular shape, and a star shape, the cross section of the core 2 is preferably formed into a circular shape so that the hardness, namely the stiffness, of the core/sheath composite filament 1 becomes uniform over the entire circumference.

A cross section of the sheath 3, the cross section being perpendicular to the lengthwise direction, is formed into a quadrangular shape such as a rectangular shape, a square shape, and a rhombic shape. Accordingly, the contact area between the sheath 3 and the surface of teeth is set to be large and corners are formed on the sheath 3, thereby improving the stain removal ability. Especially, the core/sheath composite filament 1 whose cross section is formed into a square shape or a rhombic shape is preferred because the stain removal ability thereof is not likely to change according to the tuft direction of the tufts 13 compared to the core/sheath composite filament 1 whose cross section is formed into a rectangular shape. Further, although four outer surfaces of the sheath 3 may be each formed into a flat surface, it is preferable to form each of the outer surfaces of the sheath 3 into a concave surface 4 which is gently depressed inwardly (toward the central portion of the core/sheath composite filament 1) as a core/sheath composite filament 1A shown in FIG. 4(*b*). With such a configuration, the concave surfaces 4 of the sheath 3 can hold a dentifrice, therefore, it is possible to efficiently clean the surface of teeth while sufficiently rubbing the dentifrice on the surface of teeth.

When the length L1 on each side of the quadrangular cross section of the core/sheath composite filament 1 is more than 0.30 mm, the insertability into interproximal portions and the feeling of use are deteriorated. Further, when the diameter D1 of the core 2 is less than 0.12 mm, it is not possible to sufficiently ensure the durability of the toothbrush 10. Furthermore, when the thickness of the sheath 3 is less than 0.01 mm, a problem such as separation of the sheath 3 from the core 2 occurs. Accordingly, in a case where the length L1 on each sidle of the quadrangular cross section of the core/sheath composite filament 1 is less than 0.14 mm, it is not possible to sufficiently ensure the diameter D1 of the core 2 and the thickness of the sheath 3, on the other hand, in a case where the length L1 is more than 0.30 mm, the insertability into interproximal portions and the feeling of use are deteriorated. Therefore, the length L1 is set in the range of 0.14 to 0.30 mm, preferably in the range of 0.16 to 0.24 mm, and particularly preferably in the range of 0.18 to 0.22 mm. Further, in a case where the diameter D1 of the core 2 is less than 0.12 mm, it is not possible to sufficiently ensure the durability of the toothbrush 10, on the other hand, in a case where the diameter D1 is more than 0.27 mm, the outer diameter of the core/sheath composite filament 1 becomes too large, thereby deteriorating the insertability into interproximal portions and the feeling of use. Therefore, the diameter D1 is set in the range of 0.12 to 0.27 mm, preferably in the range of 0.15 to 0.20 mm, and particularly preferably in the range of 0.16 to 0.19 mm.

In view of all of the factors described above, it is preferable to use the core/sheath composite filament 1 which is configured in such a manner that the core 2 is made of polybutylene terephthalate (PBT), the sheath 3 is made of a polyester-based thermoplastic elastomer, the cross section of the core/sheath composite filament 1 is formed into a square shape or a rhombic shape, the length on each side of the cross section of the core/sheath composite filament 1 is set in the range of 0.14 to 0.30 mm, preferably in the range of 0.16 to 0.24 mm, and particularly preferably in the range of 0.18 to 0.22 mm, and the diameter of the core 2 is set in the range of 0.12 to 0.27 mm, preferably in the range of 0.15 to 0.20 mm, and particularly preferably in the range of 0.16 to 0.19 mm. Further, when each of the tufts 13 arranged in the central part of the tufting plate 11 is composed of the core/sheath composite filaments 1 and each of the tufts 13 arranged in the peripheral part of the tufting plate 11 is composed of the monofilaments 5 made of nylon as shown in FIGS. 2 (*a*) to 2 (*c*), it is possible to sufficiently ensure the stain removal ability while ensuring the durability and the feeling of use of the toothbrush 10. Therefore, such a configuration is preferred.

Further, when the tufting holes density in the brush portion 14 is less than 16 (the number of the tufting holes/$cm^2$), there is a possibility that the stain removal ability may become insufficient. On the other hand, when the bristle density is more than 21 (the number of the tufting holes/$cm^2$), there is a possibility that the feeling of use may be deteriorated. Therefore, the bristle density is preferably set in the range of 16 to 21 (the number of the tufting holes/$cm^2$), more preferably in the range of 17 to 21 (the number of the tufting holes $cm^2$), and the most preferably in the range of 18 to 21 (the number of the tufting holes/$cm^2$).

Furthermore, when the bristle length is less than 8.5 mm, the stiffness of the bristle becomes too strong, thereby deteriorating the feeling of use. On the other hand, when the bristle length is more than 12 mm, the stiffness of the bristle becomes too weak, thereby deteriorating the feeling of use as well as reducing the brushing effect. Accordingly, the bristle length is preferably set in the range of 8.5 to 12 mm, and particularly preferably in the range of 9.0 to 10 mm. Further, the length of the core/sheath composite filament 1 and the length of the monofilament 5 may be set to be same, or also to be different.

Next, evaluation tests of the toothbrush in which the core/sheath composite filament is used will be described.

At first, an evaluation test regarding the cross sectional shape of the filament will be described.

Figure 5:
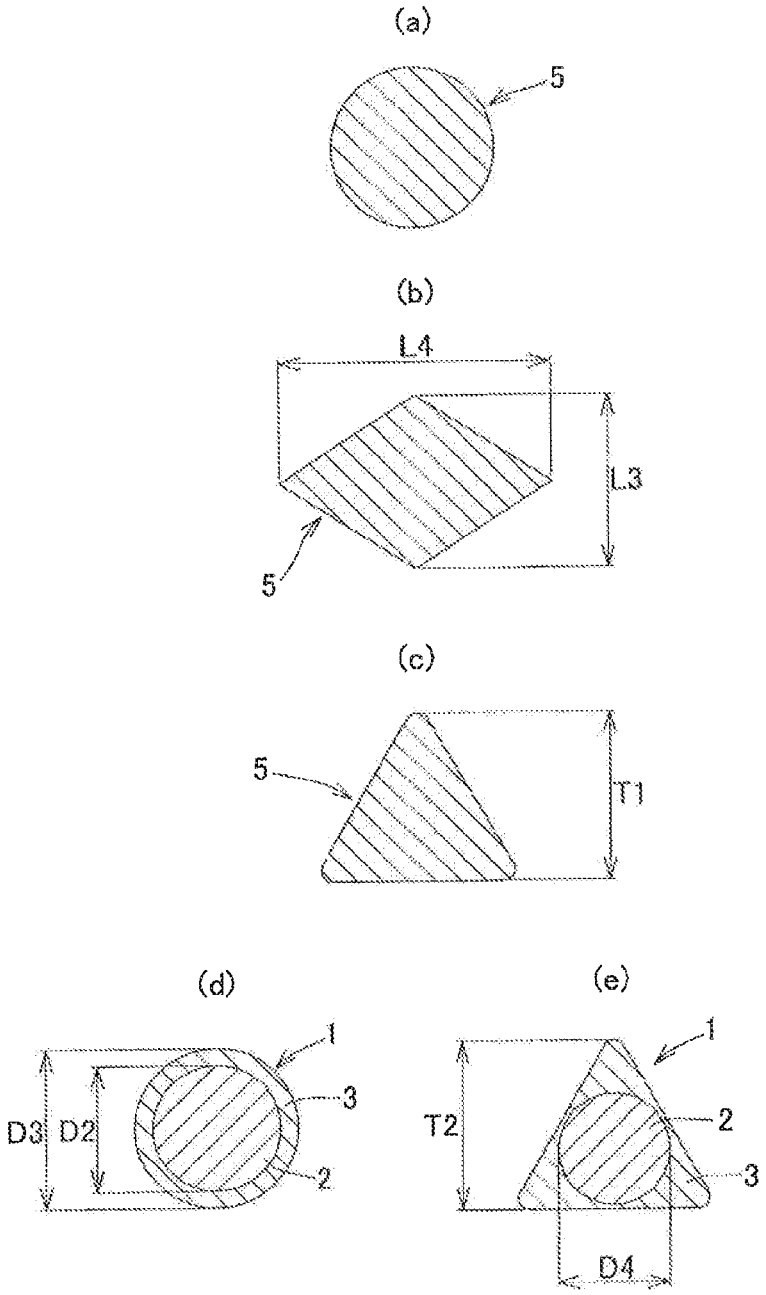
FIG. 5 (*a*), FIG. 5 (*b*), FIG. 5 (*c*), FIG. 5 (*d*) and FIG. 5 (*e*) are cross sectional views each showing a filament of a comparative example.
Figure 6:
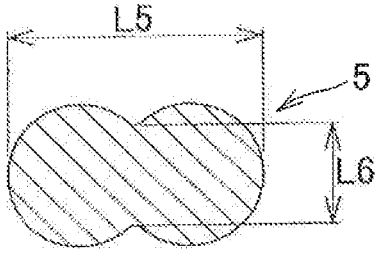
FIG. 6 (*a*) and FIG. 6 (*b*) are cross sectional views each showing a filament of a comparative example.
Figure 6:
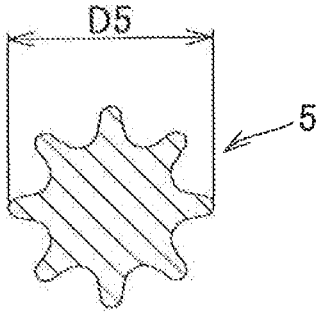

As the monofilament 5 which is made of a single synthetic resin material, there were manufactured a filament No. 1 which is made of nylon and whose cross section perpendicular to the lengthwise direction has a circular shape having a diameter of 0.19 mm as shown in FIG. 5 (*a*) and Table 1, a filament No. A1 which is made of nylon and whose cross section perpendicular to the lengthwise direction has a glasses-like shape having the longest length L5 of 0.25 mm and the shortest length L6 of 0.10 mm as shown in FIG. 6 (*a*) and Table 1, a filament No. A2 which is made of nylon and whose cross section perpendicular to the lengthwise direction has an eight-leaf shape having the greatest diameter D5 of 0.20 mm as shown in FIG. 6 (*b*) and Table 1, and a filament No. A5 which is made of nylon and whose cross section perpendicular to the lengthwise direction has a rhombic shape having a shorter diagonal L3 of 0.206 mm, a longer diagonal L4 of 0.32 mm, and a length on each side of 0.19 mm as shown in FIG. 5 (*b*) and Table 1.

Further, as the core/sheath composite filament 1 which is composed of a core/sheath composite fiber, there were manufactured a filament No. A3 and a filament No. A4, each of which has a quadrangular cross section, and includes the core 2 whose cross section has a circular shape and whose constituent material is polybutylene terephthalate and the sheath 3 whose cross section has a square shape and whose constituent material is a polyester-based thermoplastic elastomer, as shown in FIG. 1 (*a*) and Table 1. In the filament No. A3, the diameter D1 of the cross section of the core 2 is 0.15 mm, the length L1 on each side of the cross section of the sheath 3 is 0.16 mm, and the Type D durometer hardness specified in JIS K 6253 of the sheath 3 is 72D. Further, in the filament No. A4, the diameter D1 of the cross section of the core 2 is 0.16 mm, the length L1 on each side of the cross section of the sheath 3 is 0.18 mm, and the Type D durometer hardness of the sheath 3 is 72D.

Further, a toothbrush No. 1 was manufactured in such a manner that a toothbrush bundle provided with a rectangular tufting plate which has circular tufting holes and is formed in the end portion of the toothbrush shaft was prepared, tufts each of which is composed of the filaments No. 1 were tufted into the tufting holes, tips of the tufts were trimmed so as to flat a brushing surface, and the tips were further processed so as to be rounded off. Further, also with regard to the filaments No. A1 to No. A5, toothbrushes No. A1 to No. A5 each having a bristle length of 10 mm were manufactured in such a manner that each of the tufts was tufted into the respective tufting holes, and tips of the tufts were trimmed so as to flat a brushing surface, and the tips were further processed so as to be rounded off.

Next, the brush strength, the durability, the stain removal ability, and the feeling of use in each of the above-described six types of toothbrushes were measured using a measuring method which will be described later. The result will be shown in Table 1. Further, the result of an evaluation test for the feeling of use by five subjects will be shown in Table 2.

TABLE 1

| Filament (Toothbrush) No. | Cross sectional shape of filament | Material | Diameter (mm) | Brush strength ($N/cm^2$) | Durability | Spread index | Stain removal ability | | Feeling of use |
|---|---|---|---|---|---|---|---|---|---|
| 1 | Circular shape | Nylon | 0.19 | 32.3 | B | 190 | 100 | A | Moderate |
| A1 | Glasses-like shape | Nylon | Longest: 0.25<br>Shortest: 0.10 | 15.9 | C | 254 | 39 | C | Too soft and unusable |
| A2 | Eight-leaf shape | Nylon | Maximum diameter: 0.20 | 29.6 | C | 244 | 140 | A | Moderate |
| A3 | Quadrangular shape | Core: PBT (0.16 mm)<br>Sheath: TPE (D72) | Length on each side: 0.16 | 19.5 | B | 189 | 178 | B | Soft but usable |
| A4 | Quadrangular shape | Core: PBT (0.16 mm)<br>Sheath: TPE (D72) | Length on each side: 0.18 | 29.9 | A | 147 | 177 | A | Moderate |
| A5 | Rhombic shape | Nylon | Shorter diagonal: 0.206<br>Longer diagonal: 0.32<br>Length on each side: 0.19 | 17.3 | C | 218 | 172 | B | Soft but usable |

TABLE 2

| Toothbrush No. | | Subject 1 | Subject 2 | Subject 3 | Subject 4 | Subject 5 | Average value | Evaluation |
|---|---|---|---|---|---|---|---|---|
| 1 | Index | 3 | 3 | 3 | 2 | 3 | | A |
| | Point | 5 | 5 | 5 | 3 | 5 | 4.6 | |
| A1 | Index | 2 | 1 | 1 | 1 | 1 | | C |
| | Point | 3 | 1 | 1 | 1 | 1 | 1.4 | |
| A2 | Index | 3 | 2 | 3 | 3 | 3 | | A |
| | Point | 5 | 3 | 5 | 5 | 5 | 4.6 | |
| A3 | Index | 2 | 3 | 2 | 2 | 2 | | B |
| | Point | 3 | 5 | 3 | 3 | 3 | 3.4 | |
| A4 | Index | 3 | 3 | 3 | 3 | 3 | | A |
| | Point | 5 | 5 | 5 | 5 | 5 | 5.0 | |
| A5 | Index | 2 | 2 | 3 | 2 | 3 | | B |
| | Point | 3 | 3 | 5 | 3 | 5 | 3.8 | |

A: Moderate (in the range of 4.0 to 5.0)
B: Soft but usable (3.0 or more but less than 4.0)
C: Too soft and unusable (1.0 or more but less than 3.0)

It is understood from Table 1 that when the cross section of the filament, the cross section being perpendicular to the lengthwise direction, has a quadrangular shape such as a square shape and a rhombic shape as in the toothbrushes No. A3 to No. A5, the stain removal ability is improved compared to the toothbrushes No. 1, No. A1 and No. A2 in each of which the filament whose cross section has a circular shape, a glasses-like shape or an eight-leaf shape is used.

Further, even in a case where the cross section of the filament has a quadrangular shape, the toothbrush No. A4 in which the filament which is made of only nylon and has the rhombic cross section is used has higher brush strength, namely is not likely to be buckled, but has lower spread index compared to the toothbrush No. A5 in which the filament which is composed of the core/sheath composite fiber and has the square cross section is used, for example. This shows that the spread of the filaments is suppressed due to the elasticity of the sheath and the durability is thus increased in a case where the filament having a core/sheath structure in which the sheath is made of an elastomer is used compared to a case where the filament which is made of a single synthetic resin material is used.

Next, an evaluation test regarding the arrangement of the tufts will be described.

As the monofilament 5 which is made of a single synthetic resin material, there were manufactured a filament No. 1 which is made of nylon and whose cross section perpendicular to the lengthwise direction has a circular shape having a diameter of 0.19 mm as shown in FIG. 5 (*a*) and Table 3, and a filament No. 2 which is made of nylon and whose cross section perpendicular to the lengthwise direction has a rhombic shape having a shorter diagonal L3 of 0.206 mm, a longer diagonal L4 of 0.32 min and a length on each side of 0.19 mm as shown in FIG. 5 (*b*) and Table 3, a filament No. 3 which is made of nylon and whose cross section perpendicular to the lengthwise direction has a triangular shape having a height T1 of 0.20 mm as shown in FIG. 5 (*c*) and Table 3, and a filament No. 4 which is made of a polyester-based thermoplastic elastomer and whose cross section has a circular shape having a diameter of 0.2 mm as shown in Table 3.

Further, as the core/sheath composite filament 1, there were manufactured a filament No. 5 which includes the core 2 whose cross section has a circular shape having a diameter D2 of 0.15 mm and whose constituent material is polybutylene terephthalate and the sheath 3 whose cross section has a circular shape having a diameter D3 of 0.20 mm and whose constituent material is a polyester-based thermoplastic elastomer as shown in FIG. 5 (*d*) and Table 3, a filament No. 6 which includes the core 2 whose cross section has a circular shape having a diameter 134 of 0.12 mm and whose constituent material is polybutylene terephthalate and the sheath 3 whose cross section has a triangular shape having a height T2 of 0.20 mm and whose constituent material is a polyester-based thermoplastic elastomer as shown in FIG. 5 (*e*) and Table 3, a filament No. 7 which includes the core 2 whose cross section has a circular shape having a diameter D1 of 0.16 mm and whose constituent material is polybutylene terephthalate and the sheath 3 whose cross section has a square shape having a length L1 on each side of 0.18 mm and whose constituent material is a polyester-based thermoplastic elastomer as shown in FIG. 4 (*e*) and Table 3, and a filament No. 8 which is configured in the same manner as the filament No. 7 excepting that the diameter D1 of the cross section of the core 2 is set to 0.15 mm and the length L1 on each side of the cross section of the sheath 3 is set to 0.16 mm.

Further, a toothbrush having a bristle length of 10 mm was manufactured in such a manner that a toothbrush shaft provided with a rectangular tufting plate which has circular tufting holes and is formed in the end portion of the toothbrush shaft was prepared, tufts each of which is composed of the above-described filaments were tufted into the tufting holes, tips of the tufts were trimmed so as to flat a brushing surface, and the tips were further processed so as to be rounded off. Specifically, toothbrushes No. 1 to No. 7 in each of which the tufts composed of the filaments No. 1 to No. 7 are respectively tufted in the arrangement shown in Table 3 were manufactured as a toothbrush in which tufts each of which is composed of filaments having the same configuration are tufted. Further, as a toothbrush in which the tufts 13A each of which is composed of the core/sheath composite filaments 1 and the tufts 13B each of which is composed of the monofilaments 5 are tufted in a mixed state, there were manufactured a toothbrush No. 8 in which the tufts 13A each of which is composed of the filaments No. 8 as the core/sheath composite filament 1 and the tufts 13B each of which is composed of the monofilaments 5, the monofilament 5 being made of nylon and having a diameter of 0.20 mm, are tufted in a mixed state in the arrangement shown in FIG. 2 (*a*), and a toothbrush No. 9 in which the tufts 13A each of which is composed of the filaments No. 7 as the core/sheath composite filament 1 and the tufts 13B each of which is composed of the monofilaments 5, the monofilament 5 being made of nylon and having a diameter of 0.20 mm, are tufted in a mixed state in the same arrangement as that in the toothbrush No. 8. Furthermore, as a toothbrush in which the arrangement of the tufts is changed, there were manufactured a toothbrush No. 10 in which the filaments No. 1 are tufted in the arrangement shown in FIG. 3 (*b*), a toothbrush No. 11 in which the filaments No. 1 are tufted in the arrangement shown in FIG. 1 (*b*), a toothbrush No. 12 in which the filaments No. 7 each of which is composed of the core/sheath composite filament 1 are tufted in the arrangement shown in FIG. 1 (*a*), a toothbrush No. 13 in which the filaments No. 7 each of which is composed of the core/sheath composite filament 1 are tufted in the arrangement shown in FIG. 1 (*b*), and a toothbrush No. 14 in which the tufts 13A each of which is composed of the filaments No. 7 as the core/sheath composite filament 1 and the tufts 13B each of which is composed of the monofilaments 5, the monofilament 5 being made of nylon and having a diameter of 0.20 mm, are tufted in a mixed state in the arrangement shown in FIG. 3 (*a*), as shown in FIG. 1 and Table 4.

Next, the brush strength, the spread index, the durability, the stain removal ability, and the feeling of use in each of the toothbrushes No. 1 to No. 9 were measured. Further, the brush strength, the spread index, and the stain removal ability in each of the toothbrushes No. 10 to No. 14 were measured. The results will be shown in Table 3 and Table 4.

TABLE 3

| Toothbrush No. | 1 | 2 | 3 | 4 | 5 |
|---|---|---|---|---|---|
| Material of filament | Nylon | Nylon | Nylon | TPE | Core: PBT Sheath: TPE |
| Cross sectional shape of filament (Filament No.) | Circular shape (Filament No. 1) | Rhombic shape (Filament No. 2) | Triangular shape (Filament No. 3) | Circular shape (Filament No. 4) | Circular shape (Filament No. 5) |
| Outer size (mm) | Diameter: 0.19 | Length on each side: 0.19 | Height: 0.20 | Diameter: 0.20 | Diameter: 0.20 |
| Diameter of core (mm) | — | — | — | — | 0.15 |
| Arrangement of bristle bundles | Aligned (FIG. 1 (a)) | Zigzag (FIG. 1 (b)) | Zigzag (FIG. 1 (c)) | Zigzag (FIG. 1 (b)) | Zigzag (FIG. 1 (b)) |
| Brush strength ($N/cm^2$) | 32.3 | 17.3 | 36.9 | 12.8 | 20.6 |
| Bristle density ($number/cm^2$) | 16.7 | 17.6 | 23.5 | 17.6 | 17.6 |
| Stain removal ability | 100.0 | 148.6 | 117.8 | Unmeasurable | 132.8 |
| Spread index | 190 | 218 | 149 | — | 180 |
| Durability | B | C | A | Unmeasurable | B |
| Feeling of use | 4.6 | 3.4 | 4.8 | 1 | 3.8 |
| | A | B | A | C | B |

| Toothbrush No. | 6 | 7 | 8 | 9 |
|---|---|---|---|---|
| Material of filament | Core: PBT Sheath: TPE | Core: PBT Sheath: TPE | Core: PBT Sheath: TPE | Core: PBT Sheath: TPE |
| Cross sectional shape of filament (Filament No.) | Triangular shape (Filament No. 6) | Quadrangular shape (Filament No. 7) | Quadrangular shape (Filament No. 8) | Quadrangular shape (Filament No. 7) |
| Outer size (mm) | Height: 0.20 | Length on each side: 0.18 | Length on each side: 0.16 | Length on each side: 0.18 |
| Diameter of core (mm) | 0.12 | 0.16 | 0.15 | 0.16 |
| Arrangement of bristle bundles | Zigzag (FIG. 1 (b)) | Zigzag (FIG. 1 (b)) | Zigzag (FIG. 2 (a)) | Zigzag (FIG. 2 (a)) |
| Brush strength ($N/cm^2$) | 18.4 | 29.8 | 38.3 | 89.1 |
| Bristle density ($number/cm^2$) | 17.6 | 17.6 | 20.8 | 20.8 |
| Stain removal ability | 128.6 | 142.0 | 132.3 | 148.9 |
| Spread index | 192 | 147 | 162 | 154 |
| Durability | B | A | A | A |
| Feeling of use | 3 | 5 | 5 | 5 |
| | B | A | A | A |

TABLE 4

| Toothbrush No. | 10 | 11 | 12 | 13 | 8 | 9 | 14 |
|---|---|---|---|---|---|---|---|
| Material of core/sheath composite filament | Nylon | Nylon | Core: PBT Sheath: TPE | Core: PBT Sheath: TPE | Core: PBT Sheath: TPE | Core: PBT Sheath: TPE | Core: PBT Sheath: TPE |
| Cross sectional shape of filament (Filament No.) | Circular shape (Filament No. 1) | Circular shape (Filament No. 1) | Quadrangular shape (Filament No. 7) | Quadrangular shape (Filament No. 7) | Quadrangular shape (Filament No. 8) | Quadrangular shape (Filament No. 7) | Quadrangular shape (Filament No. 7) |
| Outer size (mm) | Diameter: 0.19 | Diameter: 0.19 | Length on each side: 0.16 | Length on each side: 0.18 | Length on each side: 0.16 | Length on each side: 0.18 | Length on each side: 0.18 |
| Diameter of core (mm) | — | — | 0.16 | 0.16 | 0.15 | 0.16 | 0.16 |
| Material of mixedly implanted filament | — | — | Not provided | Not provided | Nylon (Diameter: 0.20 mm) | Nylon (Diameter: 0.20 mm) | Nylon (Diameter: 0.20 mm) |
| Arrangement of bristle bundles | Aligned (FIG. 3 (b)) | Zigzag (FIG. 1 (b)) | Aligned (FIG. 1 (a)) | Zigzag (FIG. 1 (b)) | Zigzag (FIG. 2 (a)) | Zigzag (FIG. 2 (a)) | Aligned (FIG. 3 (a)) |
| Stain removal ability | 68.1 | 68.1 | 127.6 | 142.0 | 132.3 | 143.9 | 140.2 |

TABLE 4-continued

| Toothbrush No. | 10 | 11 | 12 | 13 | 8 | 9 | 14 |
|---|---|---|---|---|---|---|---|
| Spread index | 178 | 191 | 150 | 147 | 162 | 154 | Unperformed |
| Brush strength ($N/cm^2$) | 43.4 | 36.9 | 28.8 | 29.9 | 38.3 | 39.1 | Unperformed |

(Brush Strength and Bristle Density)

Each of the toothbrushes was fixed to Autograph AGS manufactured by Shimadzu Corporation which corresponds to the compression testing machine specified in old JIS B 7733, compression load was applied to the toothbrush at a velocity of 10 mm/min, and the maximum value of the compression load was then measured. After the measurement, the tuft area described in JIS S 3016 was calculated, and the maximum value measured in the compression test was then divided by the tuft area to thereby obtain the compression load per unit area as the brush strength.

Further, the bristle density was calculated by dividing the total number of the tufting holes 16 formed in the tufting plate 11 by the tuft area which had been calculated based on JIS S 3016.

(Spread Index and Durability)

Using a brushing machine manufactured by Sunstar Inc., 10000 strokes of brushing were carried out on the surface of an epoxy plate under a load of 300 g in water at 37° C., and the spread index of the brushing surface was measured to thereby evaluate the durability. In this regard, the spread index means a numerical value represented by (B/A)×100, where A (mm) denotes the horizontal width of the brushing surface in an initial state, and B (mm) denotes the horizontal width of the brushing surface after the brushing. Further, in Table 1 and Table 3, "A" indicates that the value of the durability is equal to or less than 170 and the durability is therefore excellent, "B" indicates that the value of the durability is larger than 170 but equal to or less than 200 and the durability is therefore normal, and "C" indicates that the value of the durability is larger than 200 and the durability is therefore inferior.

(Stain Removal Ability)

Stain removal ability was measured using a measuring method which is a modification of the method described in the article (Stooky et al., Journal of Dental Research, 61, 1236-39, 1982). Hereinafter, the measuring method will be described. At first, an enamel specimen of 4 mm square was cut from a bovine permanent tooth (a permanent incisor tooth), the cut enamel specimen was embedded in a clear polyester resin, and the surface of the specimen was smoothed and then mirror polished. Then, the surface of the specimen was immersed in dilute hydrochloric acid for 60 seconds, then immersed in saturated aqueous sodium carbonate solution, then immersed in 1% phytic acid solution, and then rinsed with ion-exchanged water.

A staining broth was prepared in such a manner that 1.02 g of instant coffee, 1.02 g of instant tea, 0.75 g of pig's gastric mucin, and a pigment producing bacteria (*Micrococcus luteus*) culture were added to a sterilized trypticase soy broth. Then, the specimen and the staining broth were set in an incubator at 37° C. for 10 days. On the eleventh day, 0.03 g of ferric chloride hexahydrate was added thereto and the addition was continued until L* defined in the L*a*b* color system of JIS Z 8729 became 32 to 35. Then, the specimen was removed from the staining broth and rinsed with ion-exchanged water. The rinsed specimen was used as a measurement specimen, and L*1, a*1 and b*1 of the measurement specimen were measured as a baseline using a spectrophotometer manufactured by MINOLTA CAMERA CO., LTD.

Next, the toothbrushes 10 of No. 1 to No. 7 were sequentially set in a brushing machine manufactured by Sunstar Inc., and the measurement specimen manufactured in the above-described manner was also set in the brushing machine. The toothbrush 10 was moved 1500 strokes at a constant pressure using a commercially available dentifrice. After that, the measurement specimen was allowed to dry and L*2, a*2 and b*2 of the measurement specimen were measured using the spectrophotometer manufactured by MINOLTA CAMERA CO., LTD. Further, L*3, a*3 and b*3 were measured with respect to the specimen from which the remaining stain was removed with a dental handpiece, and the stain removal rate (%) was calculated using the following formulae.

$$\text{Removed Stain}=[(L^*2-L^*1)^2+(L^*2-L^*1)^2+(L^*2-L^*1)^2]^{1/2}$$

$$\text{Total Stain(Total Removable Stain)}=[(L^*3-L^*1)^2+(L^*3-L^*1)^2+(L^*3-L^*1)^2]^{1/2}$$

$$\text{Removed Stain Rate (\%)}=(\text{Removed Stain})/(\text{Total Stain(Total Removable Stain)})$$

Further, the stain removal ability (%) of each of the toothbrushes No. 2 to No. 14, where the stain removal ability (%) of the toothbrush No. 1 which has a common configuration is defined as 100, was calculated using the following formula.

$$\text{Stain Removal Ability (\%)}=\text{Removed Stain Rate (\%) of Tested Toothbrush/Removed Stain Rate (\%) of Toothbrush No. 1}$$

(Feeling of Use)

Five subjects actually brushed their teeth using the toothbrushes No. 1 to No. 9 and evaluated the feeling of use thereof. The evaluation of the feeling of use was carried out in such a manner that the evaluation utilized a five-level index regarding hardness and points were set corresponding to each of the indexes as shown in Table 5, and the index and the point of the feeling of use with respect to each of the toothbrushes No. 1 to No. 9 by the five subjects and the average value of the points were evaluated. The result will be shown in Table 6.

TABLE 5

| | Index | | | | |
|---|---|---|---|---|---|
| | Too soft 1 | Slightly soft 2 | Moderate 3 | Slightly hard 4 | Too hard 5 |
| Point | 1 | 3 | 5 | 3 | 5 |

TABLE 6

| Toothbrush No. | | Subject 1 | Subject 2 | Subject 3 | Subject 4 | Subject 5 | Average value | Evaluation |
|---|---|---|---|---|---|---|---|---|
| 1 | Index | 3 | 3 | 3 | 2 | 3 | | A |
| | Point | 5 | 5 | 5 | 3 | 5 | 4.6 | |

TABLE 6-continued

| Toothbrush No. | | Subject 1 | Subject 2 | Subject 3 | Subject 4 | Subject 5 | Average value | Evaluation |
|---|---|---|---|---|---|---|---|---|
| 2 | Index | 2 | 2 | 3 | 1 | 3 | | B |
| | Point | 3 | 3 | 5 | 1 | 5 | 3.4 | |
| 3 | Index | 3 | 4 | 3 | 3 | 3 | | A |
| | Point | 5 | 3 | 5 | 5 | 5 | 4.6 | |
| 4 | Index | 1 | 1 | 1 | 1 | 1 | | C |
| | Point | 1 | 1 | 1 | 1 | 1 | 1.0 | |
| 5 | Index | 2 | 3 | 2 | 2 | 3 | | B |
| | Point | 3 | 5 | 3 | 3 | 5 | 3.8 | |
| 6 | Index | 2 | 2 | 3 | 1 | 2 | | B |
| | Point | 3 | 3 | 5 | 1 | 3 | 3.0 | |
| 7 | Index | 3 | 3 | 3 | 3 | 3 | | A |
| | Point | 5 | 5 | 5 | 5 | 5 | 5.0 | |
| 8 | Index | 3 | 3 | 3 | 3 | 3 | | A |
| | Point | 5 | 5 | 5 | 5 | 5 | 5.0 | |
| 9 | Index | 3 | 3 | 3 | 3 | 3 | | A |
| | Point | 5 | 5 | 5 | 5 | 5 | 5.0 | |

A: Moderate (in the range of 4.0 to 5.0)
B: Soft but usable (3.0 or more but less than 4.0)
C: Too soft and unusable (1.0 or more but less than 3.0)

It is understood from Table 3 that the toothbrush in which the filament whose cross section has a quadrangular shape such as a rhombic shape and a square shape is used has a superior stain removal ability than that of the toothbrush in which the filament whose cross section has a circular shape or a triangular shape is used. When the cross section of the filament is formed into a quadrangular shape in this manner, the contact area between the filament and the surface of teeth is increased, and corners of the filament are strongly rubbed on the surface of teeth, thereby making it possible to efficiently remove stains.

Further, it is understood from the comparison between the toothbrush No. 11 and the toothbrush No. 5 that the stain removal ability in a case where the core sheath composite filament 1 which is provided with the sheath made of an elastomer is used is higher than the stain removal ability in a case where the monofilament 5 which is made of nylon is used, even though both of the core/sheath composite filament 1 and the monofilament 5 have a circular cross sectional shape. By providing the sheath made of an elastomer in the outer circumferential portion of the filament in this way, the frictional resistance between the filament and the surface of teeth is increased, thereby making it possible to efficiently remove stains. However, the toothbrush No. 4 in which the filament which is made of only an elastomer is used is too soft and the feeling of use thereof is thus bad. Therefore, the toothbrush No. 4 is unusable as a toothbrush.

Further, it is understood that, in a case where the tufts 13B each of which is composed of the monofilaments 5 made of nylon are arranged in the peripheral part of the tufting plate and the tufts 13A each of which is composed of the core/sheath composite filaments 1 are arranged in the central part of the tufting plate as the toothbrushes No. 8 and No. 9, it is possible to increase the brush strength while sufficiently ensuring the stain removal ability compared to a case where a toothbrush includes only the tufts 13 each of which is composed of the core/sheath composite filaments 1 as the toothbrush No. 7. This is obvious from the fact that, even in a case where the tufts are arranged in the same arrangement as in the toothbrushes No. 12 and No. 14, the toothbrush No. 14 in which the tufts 13B each of which is composed of the monofilaments 5 made of nylon are arranged in the peripheral part of the tufting plate and the tufts 13A each of which is composed of the core/sheath composite filaments 1 are arranged in the central part of the tufting plate has higher stain removal ability compared to the toothbrush No. 12 which includes only the tufts 13 each of which is composed of the core/sheath composite filaments 1.

On the other hand, Table 4 shows that, in a case where the tufts are composed of only the monofilaments 5 made of nylon, the toothbrushes No. 1 and No. 10 with the aligned bristle arrangement which includes the brush portion 14M in which three or more columns of the tufts are continuously arranged in an aligned state as shown in FIGS. 1(*a*) and 3(*b*) has equal or superior stain removal ability compared to the toothbrush No. 11 shown in FIG. 1 (*b*) with the zigzag bristle arrangement which includes only the brush portion 14T in which the tufts are arranged in a zigzag state. Further, Table 4 also shows that, in a case where the core/sheath composite filament is used, the toothbrush No. 13 with the zigzag bristle arrangement which includes only the brush portion 14T in which all of the tufts 13 are arranged in a zigzag state as shown in FIG. 1 (*b*) has superior stain removal ability compared to the toothbrush No. 12 with the aligned bristle arrangement which includes the brush portion 14M in which three or more columns of the tufts 13 are continuously arranged in an aligned state as shown in FIG. 1 (*a*), contrary to the case where the monofilament 5 made of nylon is used. Namely, it is understood that it is possible to improve the stain removal ability in the core/sheath composite filament 1 by arranging the tufts in the zigzag arrangement.

Further, the toothbrushes No. 12 and No. 13 in which the tufts each of which is composed of the core/sheath filaments 1 are tufted have superior stain removal ability, but slightly lower brush strength compared to the toothbrushes No. 10 and No. 11 in which the tufts each of which is composed of the monofilaments 5 made of nylon are tufted. On the other hand, it is understood that, in the toothbrushes No. 8 and No. 9 in which the tufts 13B each of which is composed of the monofilaments 5 made of nylon are arranged in the peripheral part of the tufting plate and the tufts 13A each of which is composed of the core/sheath composite filaments 1 are arranged in the central part of the tufting plate as shown in FIG. 2 (*a*), it is possible to improve the brush strength while at the same time sufficiently ensuring the stain removal ability.

REFERENCE SIGNS LIST

1 Core/sheath composite filament
1A Core/sheath composite filament
2 Core
3 Sheath
4 Concave surface
5 Monofilament
10 Toothbrush
11 Tufting plate
11A to 11H Tufting plates
12 Handle
13 Tuft
13A Tuft
13B Tuft
14 Brush portion
14M Brush portion
14T Brush portion
15 Neck portion
16 Tufting hole

The invention claimed is:

1. A core/sheath composite filament for toothbrushes comprising:

a core made of a synthetic resin fiber; and a sheath integrally covering the core, the sheath being made of an elastomer compatible with the synthetic resin constituting the core, wherein a cross section of the core/sheath composite filament, the cross section being perpendicular to a lengthwise direction, is formed into a quadrangular shape, and a length on each side of the quadrangular shape of the sheath is in the range of 0.16 mm to 0.30 mm.

2. The core/sheath composite filament for toothbrushes according to claim 1, wherein the core is made of a polyester-based synthetic resin fiber and the sheath is made of a thermoplastic elastomer (TPE).

3. The core/sheath composite filament for toothbrushes according to claim 1, wherein the core is made of polybutylene terephthalate (PBT) and the sheath is made of a polyester-based thermoplastic elastomer (TPE).

4. The core/sheath composite filament for toothbrushes according to claim 1, wherein a length on each side of the cross section of the core/sheath composite filament is in a range of 0.14 to 0.30 mm.

5. The core/sheath composite filament for toothbrushes according to claim 1, wherein a cross section of the core, the cross section being perpendicular to the lengthwise direction, has a circular shape.

6. The core/sheath composite filament for toothbrushes according to claim 5, wherein a diameter of the core is in a range of 0.12 to 0.27 mm.

7. A toothbrush comprising a brush portion having a tufting plate and a plurality of tufts tufted in the tufting plate, wherein the tuft including the core/sheath composite filament for toothbrushes according to claim 1 is used in the toothbrush.

8. The toothbrush according to claim 7, wherein when a longitudinal direction of the toothbrush is defined as a row direction and a direction perpendicular to the longitudinal direction of the toothbrush is defined as a column direction, at least one pair of centers of tufting holes, the tufting holes being located nearest to each other in adjoining columns has a portion not being located on a straight line parallel to the longitudinal direction of the toothbrush in the tufting plate.

9. The toothbrush according to claim 7, wherein the tufts include a tuft configured by bundling a plurality of the core/sheath composite filaments and tufted in a central part of the tufting plate and a tuft configured by bundling a plurality of monofilaments made of a hard synthetic resin and tufted in a peripheral part of the tufting plate.

* * * * *